United States Patent [19]

Adriaansen

[11] Patent Number: 4,561,135

[45] Date of Patent: Dec. 31, 1985

[54] BABY BATH

[75] Inventor: David Adriaansen, Arlington, Mass.

[73] Assignee: Tucker Housewares, Inc., Leominster, Mass.

[21] Appl. No.: 641,252

[22] Filed: Aug. 16, 1984

[51] Int. Cl.[4] ..... A47K 3/024

[52] U.S. Cl. ..... 4/572

[58] Field of Search ..... 4/572, 571, 575, 578, 4/579, 586, 548, 584; D23/52

[56] References Cited

U.S. PATENT DOCUMENTS

D. 274,167 6/1984 Lyne ..... 4/572

4,216,552 8/1980 Gurolnick ..... 4/572

FOREIGN PATENT DOCUMENTS 360473 4/1962 Switzerland ..... 4/572

*Primary Examiner*—Stephen Marcus

*Assistant Examiner*—Leo Peters

*Attorney, Agent, or Firm*—Charles R. Fay

[57] ABSTRACT

A baby bath of one-piece molded plastic for temporary use in a single or double basin sink, or on a flat surface.

6 Claims, 6 Drawing Figures

BABY BATH

FIELD OF THE INVENTION

One-piece molded plastic portable baby bath for use with a single basin kitchen sink, a double basin sink, or on a flat surface.

BACKGROUND OF THE INVENTION

Light weight plastic baby baths for use with conventional sinks have proved of considerable convenience, but are found to be capable of use only with a very small infant, to two or three months of age.

Because of this invention's unique configuration, the new bath can be used for a longer period of time.

U.S. Pat. No. 4,216,552 is a recent example of the prior art.

SUMMARY OF THE INVENTION

A one-piece molded bath has continuous sides and ends to hold the bath water. An inclined bottom that rises above the sides and ends supports the baby and this comprises the major portion of the length of the bath for the washing of infants up to six months of age. The baby support is wholly within the confines of the bath so the baby's head is supported wholly inboard of the bath for additional safety.

At each side of the bottom incline that supports the baby there is a depression or depressed hollow leg extending downwardly and these are hollow and act as fore and aft supports or stops for the divider of a double sink, and together partly with the underside of the bottom incline, and partly with bottom portions of the bath adjacent to the legs, fix the position of the bath relative to the sink. The sink divider is just below the baby's torso, and this again is a safety support feature. The baby support incline and the depressed legs also inclined, but in opposed relation to the baby support, are configured to position the bath in the double sink.

At the foot end of the bath opposite the high point of the baby support incline there is a pair of spaced depressions for articles, and these have bottoms that are coplanar with upper portions of the legs and act as supports remote from the sink divider, and also they act to support this end of the bath in a single basin sink. The other supports for the bath with a single basin reside in upper portions of the legs at the extreme end of the bath.

The inclined portion of the baby support is configured to the baby's body for holding it as still as possible and comfortably and safely.

PREFERRED EMBODIMENT OF THE INVENTION

Figure 1:
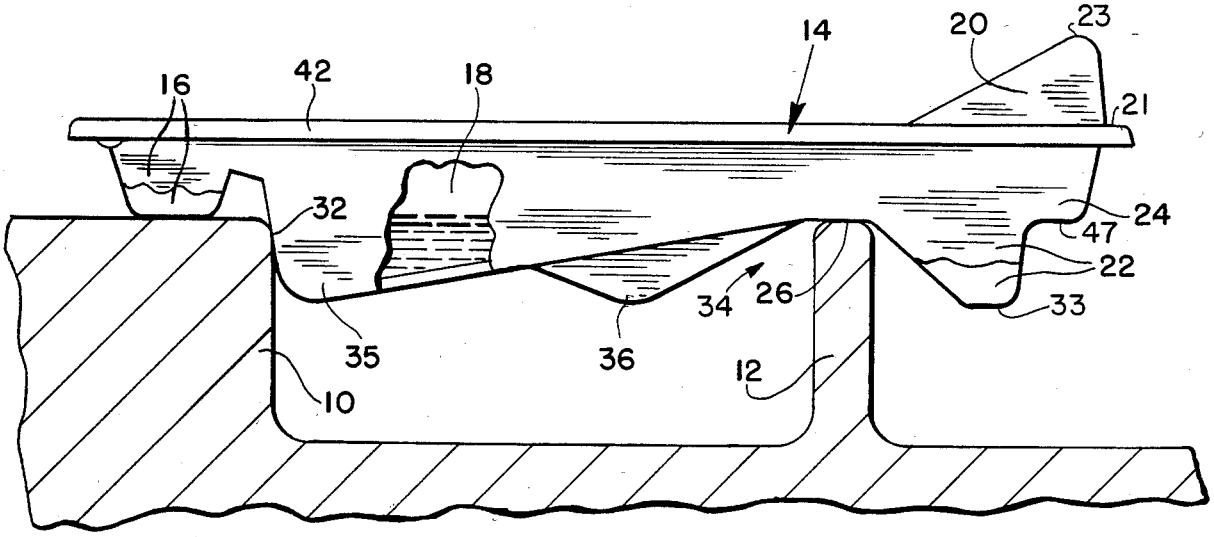
FIG. 1 is a view in side elevation showing the bath on a double basin sink.

In FIG. 1 there is shown a double basin sink having an end at 10 and a divider at 12. The baby bath 14 has small spaced front end depressions 16, a larger central water receiving depression 18, a back rest 20, two rear end legs 22, just alike, one at either side of the back rest as will be described, and there is a rear end extension 24 for each leg 22. The back rest is inclined and extends down to the left forming the bottom of the water holding area 18.

In FIG. 1, which shows a conventional divider 12 for the sink, the front depression 16 rests on the sink at edge 10 and the apex at 26 between the inclined back rest and the legs 22 receives the sink divider 12 and support 12 and holds the bath in fore and aft generally fixed relation.

Figure 2:
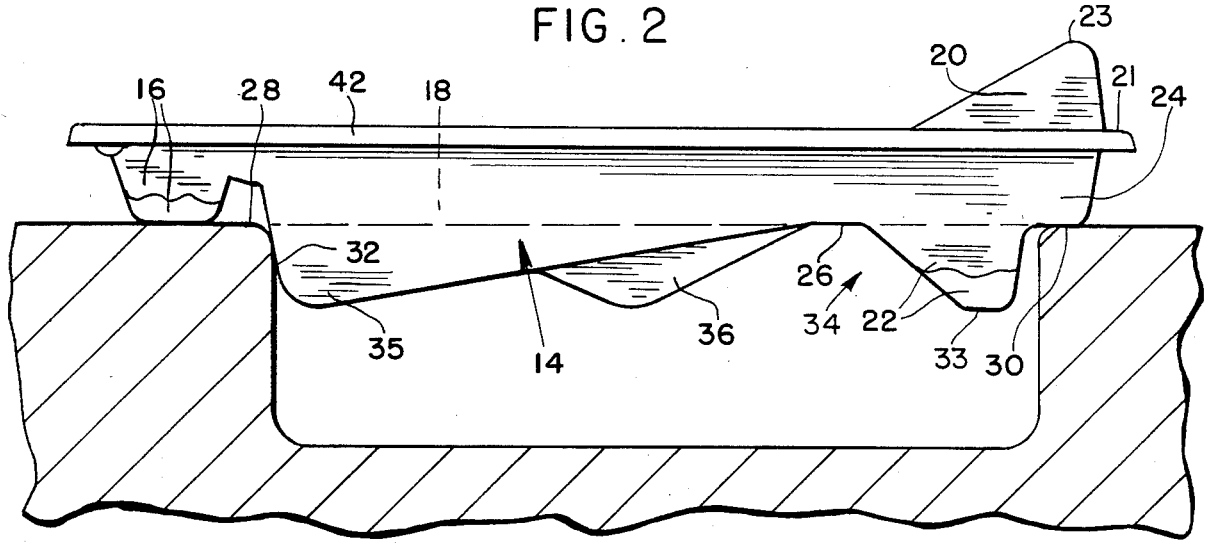
FIG. 2 is a similar view showing the bath on a single sink.

In FIG. 2, the same bath is supported on a single basin sink having ends 28 and 30 with rear extensions 24 and front depressions 16 supporting the bath on the sink ends. In this case, the bath is also generally fixed by rear legs 22 and the front end wall 32 of the bath.

Therefore, it is seen that the baby is inboard of the bath and of the sink while being washed, and the baby is well supported by the divider 12 in FIG. 1. No part of the baby's body projects out from the supports for the bath in either instance and in FIG. 1, the divider gives the baby an added support and thus protection. On the other hand, almost the entire bath is utilized in holding the baby during the bathing, and a larger baby can be bathed.

The bath 14 comprises a front wall 32, a bottom 15, a pair of opposite side walls 17 and 19 and a rear wall area 21. The front wall 32, the bottom 15 and the side walls 17 and 19 generally define the central water receiving depression 18. The bottom 15 is inclined upwardly and rearwardly from the deepest area 35 of the depression 18 adjacent the front wall to a highest point 23 adjacent the rear wall area 21. The bottom 15 includes a back rest portion 20 which is narrower than the bottom 15 and is spaced inwardly from the wide walls 17 and 19, forming spaces between the side walls and the back rest portion 20. Narrow strips 25 and 27 of the bottom 15 extend rearwardly on opposite sides of the back rest portion 20 between the back rest portion and the side walls 17 and 19 respectively. The strips 25 and 27 continue the general upward incline of the portion of bottom 15 in front of the back rest portion 20 to an apex 26 where they flatten out providing flat surface portions on their undersides for seating on top of the divider 12 of a double basin sink. Depressions formed in the strips 25 and 27 rearwardly of the apex 26 provide a pair of hollow legs 22 on opposite sides of the back rest portion 20 which are located below and intermediate the extent of the back rest portion 20. The legs 22 have terminal flat bottom surfaces 33 which are substantially the same distance beneath the peripheral rim 42 of the bath as the deepest portion of the bath 35 thereby providing with the bottom of the bath, at the deepest portion 35, supports for resting the bath 14 on a flat surface, such as a table top (not shown). The legs 20 have forwardly sloping surfaces which join the apex 26. The legs 22, apexes 26 and the back rest 20 from a transverse recess 34 across the width of the bath 14 for receiving the divider 12 of a double basin sink between them. Upstanding inner side walls 37 and 39 and an upstanding rearwall 46 support the inclined forwardly facing upper surface of the back rest portion 20. A member 43 extending forwardly of the front wall 32 of the bath 14 has depressions 16 formed therein. The bottom surfaces 45 of the depressions 16 are substantially coplanar with the bottom surfaces 47 of the rear extensions 24.

Figure 6:
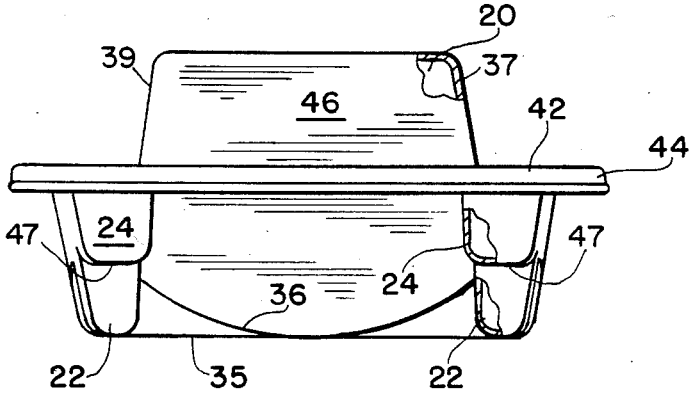
FIG. 6 is an end view looking in the direction of arrow 6 in FIG. 3.
Figure 3:
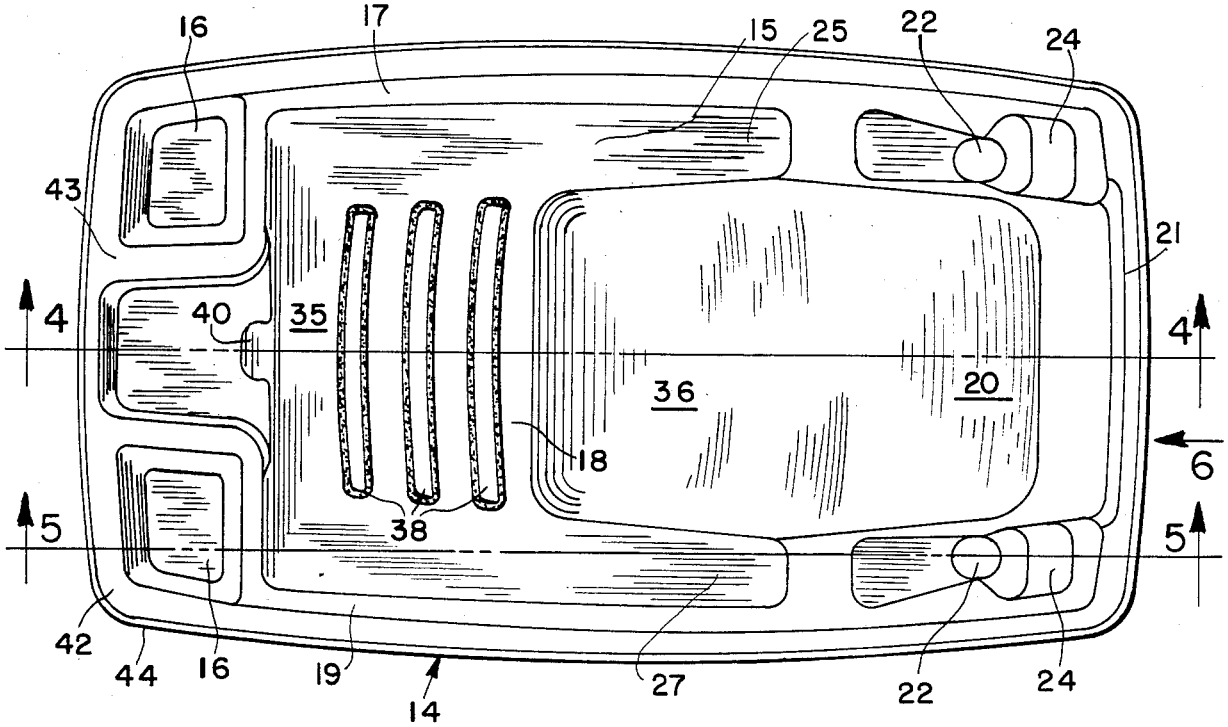
FIG. 3 is a top plan view of the bath.
Figure 4:
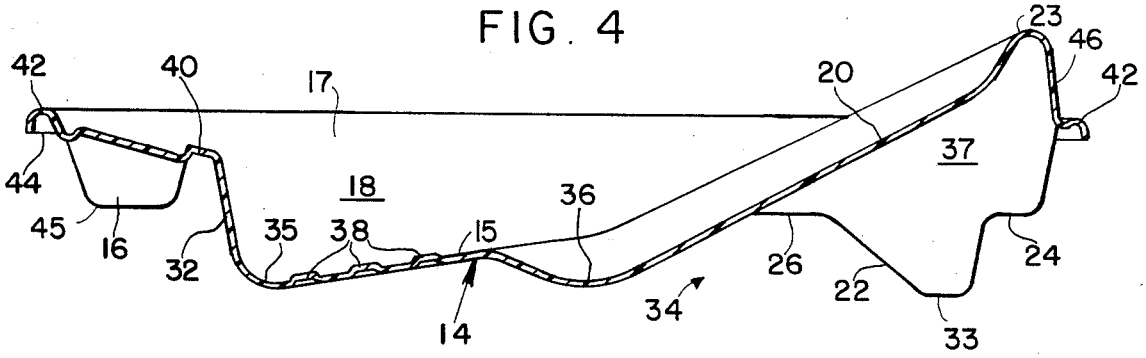
FIG. 4 is a sectional view on line 4—4 of FIG. 3.
Figure 5:
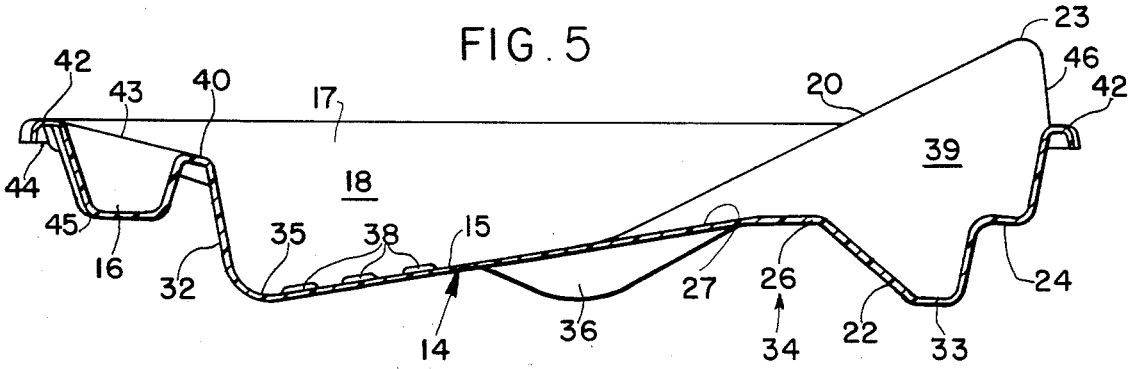
FIG. 5 is a sectional view of the bath on line 5—5 of FIG. 3.

Referring to FIG. 3, it will be seen that the rear end legs 22 are located laterally with respect to the inclined back or body rest 20 and this relationship is also brought out in FIG. 6. The deepest area of the bath where the occupant's feet are located, is indicated at 35, and a downwardly extending bulge 36 of rounded shape is provided to better accommodate the baby's anatomy. Between the forward end depressions 16, there may be provided a contoured shape 40 for soap, etc., the depressions 16 having a double use as article containers for any bath accessories. It will be noted that the bath in general has a rim 42 which may run all around it, but this rim has no function except to stiffen the molded plastic piece, or to act as handles if desired. For this reason, the rim may have a downturned edge 44, see FIGS. 4 and 5. The back rest 20 may be slightly concave as desired.

Anti-skid stippling may be provided on molded-in ribs 38. Anti-skid rubber feet may be applied to the bottoms of legs 22 as the bath may be placed and used on a flat surface on legs 22 and the underside of the bottom of the bath at 35, with no sink involved.

Since the entire bath is one-piece molded plastic of small thickness, it is very light weight and easily handled. A covering of suitable soft material may be applied to the back rest and depression 36 for the baby's comfort.

I claim:

1. A portable molded plastic one-piece bath configured for use on a single or double basin sink having a divider, said bath comprising a front wall, a bottom, a pair of opposite side walls and a rear wall area, the bottom being inclined from a deepest area adjacent the front wall to a highest point adjacent the rear wall area, said bottom rising to a point well above and forward of the rear wall area, said bottom including a back rest portion narrower than the bottom and spaced inwardly from the side walls, forming spaces between the side walls and the back rest, said bottom having a narrow strip on each side of said back rest portion between said back rest portion and said opposite side walls, a downwardly extending depression formed in each narrow strip, said depressions forming a rear legs for the bath, said legs being located intermediate the extent of the back rest portion, said legs, narrow strips and said back rest portion being configured and dimensioned to form a transverse recess across the width of said bath for receiving the divider of a double basin sink between them, thereby positioning the bath with the divider below the back rest and thereby below the bath occupant, each narrow strip having a flat surface portion for seating on the top of said divider, hollow extensions on said legs, said extensions being shorter than the legs and extending rearwardly thereof, spaced depressions in the bath forwardly of the front wall and integral therewith, said front depressions having bottom surfaces generally co-planar with said extensions, and forming therewith fore and aft supports for the bath in a single basin sink.

2. The bath of claim 1 including an integral member extending forwardly of the front wall at the top thereof, the depressions that are forward of the front wall being in said member.

3. A portable one-piece light weight bath for babies shaped for use on a single basin sink comprising a front wall, sides, rear, and bottom, the bottom inclining from a maximum depth at the front wall to a maximum height at the rear, a forwardly extending member at the front wall above the bottom, at least one depression in said member, the depression having a bottom intermediate the member and the maximum depth of the bottom, at least one depression at the rear adjacent the bottom, a hollow extension on the rear depression, said extension extending rearwardly from the rear depression and having a bottom intermediate the lowest portion of the rear depression and the top portion thereof, the bottoms of the first named forward depression and the extension on the rear depression being generally co-planar and forming supports for the bath on a single basin sink.

4. The bath of claim 3 wherein the extensions on the rear depression are located beneath the area of the maximum height of the inclined bottom.

5. The bath of claim 4 wherein the bottom of the rear depression is co-planar with the bottom of the bath at its maximum depth.

6. A one-piece molded plastic baby bath comprising a front wall, a member extending forwardly thereof from the top of the front wall, spaced depressions in the member extending down for a part only of the height of the front wall, side walls having co-planar upper edges, a generally inclined bottom having a maximum depth adjacent the front wall and a maximum height removed therefrom at the rear of the bath, the bottom at its rear end maximum height being higher than the upper edges of the side walls, a rear wall, legs extending down from the bottom of the bath adjacent the maximum height thereof, portions of the legs extending rearwardly therefrom, the legs terminating in bottoms generally co-planar with the bottom of the bath at its maximum depth, the rearwardly extending portions of the legs having bottoms intermediate the extent of the legs downwardly and being generally co-planar with the bottom portions of the spaced depressions, and a gap between the legs and the inclined bottom, said gap extending transversely of the bath parallel to the front and rear walls.

* * * * *